US005504971A

United States Patent [19]

McCormick

[11] Patent Number: 5,504,971

[45] Date of Patent: Apr. 9, 1996

[54] VACUUM CLEANER WITH ADJUSTABLE SPEED POWER ASSIST

[75] Inventor: Michael J. McCormick, Danville, Ky.

[73] Assignee: Matsushita Appliance Corporation, Danville, Ky.

[21] Appl. No.: 893,914

[22] Filed: Jun. 4, 1992

[51] Int. Cl.[6] ..... A47L 9/00

[52] U.S. Cl. ..... 15/340.2; 74/501.6; 74/502.6; 180/19.3; 192/21

[58] Field of Search ..... 15/340.2; 180/19.3; 74/501.5 R, 501.6, 502.6; 192/21

[56] References Cited

U.S. PATENT DOCUMENTS

| | | | |
|---|---|---|---|
| 1,459,946 | 6/1923 | Camarata et al. | 15/340.2 |
| 1,465,285 | 8/1923 | Peterson | 15/340.2 |
| 2,138,239 | 11/1938 | Irgens | 15/340.2 |
| 2,619,209 | 11/1952 | Horn | 180/19.3 |
| 2,700,863 | 2/1955 | Etem | 15/340.2 |
| 2,814,063 | 11/1957 | Ripple | 15/340.2 |
| 3,218,876 | 11/1965 | Berger | 15/340.2 |
| 3,220,043 | 11/1965 | Lampe | 15/340.2 |
| 3,451,495 | 6/1969 | Bayless et al. | 15/340.2 |
| 3,618,687 | 11/1971 | Ripple et al. . | |
| 3,823,791 | 7/1974 | Sheler | 15/340.2 |
| 4,249,281 | 2/1981 | Meyer et al. . | |
| 4,347,643 | 9/1982 | Bair . | |
| 4,434,865 | 3/1984 | Tschudy et al. | 15/340.2 |
| 4,615,071 | 10/1986 | Frohbieter | 15/340.2 |
| 4,624,027 | 11/1986 | Martin | 15/340.2 |
| 4,754,520 | 7/1988 | Steadings et al. | 15/340.2 |
| 4,766,640 | 8/1988 | Martin et al. . | |
| 5,115,537 | 5/1992 | Meyer et al. | 15/340.2 |

*Primary Examiner*—Mark Spisich

*Attorney, Agent, or Firm*—Amster, Rothstein & Ebenstein

[57] ABSTRACT

A self propelled upright vacuum cleaner drive system integral with the axle of the drive wheels including an operator controlled reversing clutch transmission incorporating a separate unidirectional AC motor for forward and reverse control of the drive system independent from the vacuum cleaner suction motor. A triac controlled variable speed adjust circuit controls the rotational speed of the motor and thus the driven wheels on the base unit, while-a separate operator controlled adjustable response mechanism sets the engagement tension of the vacuum cleaner and transmission assembly corresponding to either a quick or a slow response of the axle of the drive wheels when actuated by the operator.

31 Claims, 3 Drawing Sheets

VACUUM CLEANER WITH ADJUSTABLE SPEED POWER ASSIST

BACKGROUND OF THE INVENTION

1. Field of the Invention

The present invention relates to upright vacuum cleaners and, more particularly, concerns power assisted upright vacuum cleaners.

2. Description of the Prior Art

Of the various types of vacuum cleaners, one is an upright vacuum cleaner. The upright vacuum cleaner generally includes a base unit attached to a shaft/handle structure designed to be moved as an entire unit along a floor covering, such as carpet, in order to suction up dirt, debris, and other objects. The base unit of the upright vacuum cleaner is supported on an axle having two wheels, and includes an operating motor that drives an impeller to provide suction to the base unit so that dirt, dust, and other debris or particulate matter from the floor can be deposited in a disposable bag. The base unit additionally includes a rotating agitator brush which also makes contact with the floor to assist in the cleaning process. The agitator brush is generally connected to the drive or suction motor via a belt so as to rotate the agitator brush when the impeller and vacuum cleaner is on.

In those vacuum cleaners of the prior art that do not have an internal drive system so as to be power assisted or self propelled, the vacuum cleaner is manually moved by the operator along the floor by exerting a pushing or pulling motion on the handle and shaft generally pivotally connected to the base unit. A considerable amount of force may be required to push or pull the vacuum cleaner over certain floor coverings, especially carpets such as deep pile or shag carpet. In addition, many of the vacuum cleaners are relatively heavy due to the weight of their operating motors and other components. Because of this, many vacuum cleaners have been provided with an internal drive system to assist the operator in propelling the cleaner in forward and reverse directions.

These power assisted vacuum cleaners generally comprise an internal drive system disposed within the base unit including some type of transmission. Transmissions of the prior art have included independent bidirectional motors which engage the drive wheels to provide forward and reverse driving modes, and operator controlled clutches providing forward and reverse driving modes connected to the vacuum cleaner suction motor via a belt or gear arrangement. In all cases, the transmission forming a part of the drive system is mounted integrally with or directly on the axle of the drive wheels, or alternatively connected to the axle of the drive wheels via belts and pulleys. In the case of transmissions incorporating operator controlled clutches, the drive system is made rotationally operable through connection of the vacuum cleaner suction motor with the transmission via belts and pulley or gears. Thus, since the transmissions of the prior art are all connected to the vacuum cleaner suction motor, the drive system cannot be slowed down without decreasing the speed of the suction motor, consequently decreasing the suction power of the vacuum.

The bidirectional motors of the prior art suffer from jerking motion and rough start up, since the motor must reverse its rotational direction when the operator wishes to change from a forward to a reverse direction or from a reverse to a forward direction. The rapid and recurrent direction changes associated with vacuum cleaning in general reduces the brush life and the overall life expectancy of the motor, as well as being tiresome to the operator.

Typically, the internal drive system is placed in either a neutral or inoperative mode whenever the drive wheels are not to be driven or in an operative mode whenever the drive wheels are to propel the cleaner, either in a forward or reverse direction. The modes of the drive system are determined, in some vacuum cleaners of the prior art, by the movement of a slidable handle grip on the distal end of the handle shaft. The handle grip is to connected to a Bowden or other type of sheathed cable which is in turn connected to the transmission unit of the drive system. Thus, when the operator pushes the vacuum cleaner in the forward direction the handle is pushed forward moving the attached cable forward thereby engaging the drive wheels in the forward direction, when the operator pulls the vacuum cleaner in the reverse direction the handle is pulled backward moving the attached cable such that the drive wheels are engaged in the reverse direction.

The control systems of the prior art, however, were abrupt when changing directions as the transmission was either fully engaged or disengaged. Further, there was a tendency to have a slapping action thus giving a jerking motion or feeling when the control systems of the prior art engaged the transmission.

SUMMARY OF THE INVENTION

Accordingly, the present invention provides in an upright vacuum cleaner a reversing clutch integral with the drive axle driven by a unidirectional transmission drive motor separate from the suction motor, thereby providing a power assisted upright vacuum cleaner.

The present invention further provides in an upright vacuum cleaner with a power assist, an adjustable transmission response unit disposed in the operator control assembly providing the operator with variable transmission engagement depending on the type of response desired.

By providing a separate unidirectional AC motor directly connected to the transmission gearing, the transmission speed and therefore the vacuum cleaner speed is not dependent upon the suction motor, and thus suction power is not decreased upon a speed reduction of the transmission speed.

Further, by providing an independent unidirectional motor, there are no reversals of the motor which degrade motor performance and shorten the life expectancy. The transmission is also in a direct drive relationship with the unidirectional motor and with the axle of the drive wheels allowing easy assembly within the vacuum cleaner housing without cumbersome belt hookups.

By providing the control mechanism with a variable transmission response assembly, the operator may choose the type of transmission response they desire from the control assembly. The transmission response assembly can be set such that the transmission is either slowly or quickly engaged or disengaged upon actuation of the control assembly by the operator.

An upright vacuum cleaner is provided with a transmission drive system integral with the axle of the drive wheels having a unidirectional AC motor separate from the suction motor connected by a pinion gear to a clutch gear of the transmission. A clutch actuator selectively engages the clutch gearing depending on the desired direction of motion through an operator controlled Bowden or sheathed cable attached to the handle of the vacuum cleaner. Movement of the handle in the forward or reverse direction respectively determines the direction of movement of the base unit controlled by the transmission.

An operator controlled transmission response assembly is connected at the handle which allows the operator to set the engagement response of the transmission in reaction to handle movement such that a slow response requires a maximum handle displacement and a fast response requires a minimum handle displacement.

It is thus an object of the present invention to provide a power assisted upright vacuum cleaner with a smooth transition transmission whose rotational speed is independent from the suction motor.

It is further an object of the present invention to provide a power assisted upright vacuum cleaner having an adjustable operator control response.

It is still further an object of the present invention to provide a power assisted upright vacuum cleaner that is easy to assemble.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
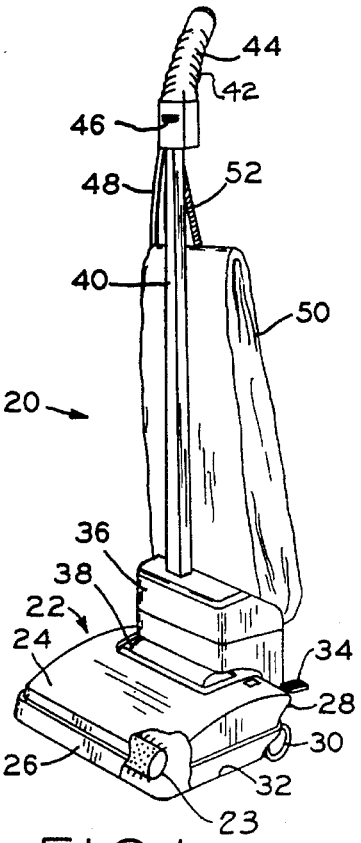
FIG. 1 is an elevational view of an upright vacuum cleaner.

Corresponding reference characters indicate corresponding parts throughout the several views. The exemplifications set out herein illustrate a preferred embodiment of the invention, in one form thereof, and such exemplifications are not to be construed as limiting the scope of the invention in any manner.

DESCRIPTION OF THE PREFERRED EMBODIMENT

Referring now to FIG. 1 there is illustrated a power assisted upright vacuum cleaner 20 constructed in accordance with the principles of the present invention. Vacuum cleaner 20 comprises a base unit 22 having a cover or hood 24 with a front end 26, a rear end 28, and a bottom edge 32 supported by a pair of wheels 30 and 31 (see FIG. 2). Base unit 22 forms a vacuum chamber in which is disposed an agitator brush 22. driven by a suction motor 63(see FIG. 2). Base unit 22 further includes a height adjuster lever 34 for increasing or decreasing the height of the base unit 22 thereby accommodating varying heights of floor coverings in order to provide optimum vacuum cleaning. A drive system housing 36 is pivotally mounted in a central recess 38 of base unit 22, and houses, as hereinbelow described, the drive system of the present invention. An elongated handle tube 40 is connected on one end to the drive system housing 36 and terminates with a handle assembly 42 on the distal end thereof. Handle assembly 42 includes a handle grip 44 and a thumbwheel 46, described hereinbelow in conjunction with FIGS. 7–9, for adjusting transmission response. Attached to handle tube 40 is a power cord 48 and a particulate collection bag 50 being connected to handle tube 40 via spring retainer 52.

Figure 2:
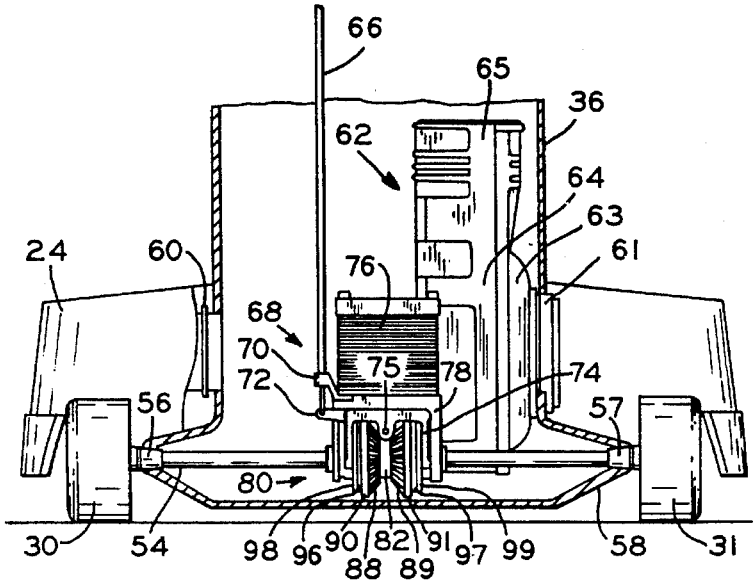
FIG. 2 is an enlarged, cutaway elevational rear view of the vacuum cleaner depicted in FIG. 1.

Referring to FIG. 2, there is shown the drive system comprising the transmission assembly 68 as mounted within the vacuum cleaner drive system housing 36. The transmission assembly 68 is mounted directly on or made integral with axle 54 supported by axle bearings 56 and 57 and axle support 58, terminating at attached wheels 30 and 31. Cover 24 is shown supported by supports 60 and 61 which permit the base unit 22 to be pivotable on a horizontal plane to adjust the height of the base unit 22 through height adjuster 34. Also disposed within drive system housing 36 is a suction assembly 62 which includes a suction motor 63 in communication with an impeller housing 64 having an internal impeller (not shown) and a suction conduit 65. The suction assembly 62 has a motor and system for providing suction power to suction up the dirt and debris from the floor covering into the base unit 22 and into the bag 50. The suction motor 63 is independent of the drive system of the present invention and thus does not drive and constrain the drive speed of the vacuum cleaner power assist.

Figure 3:
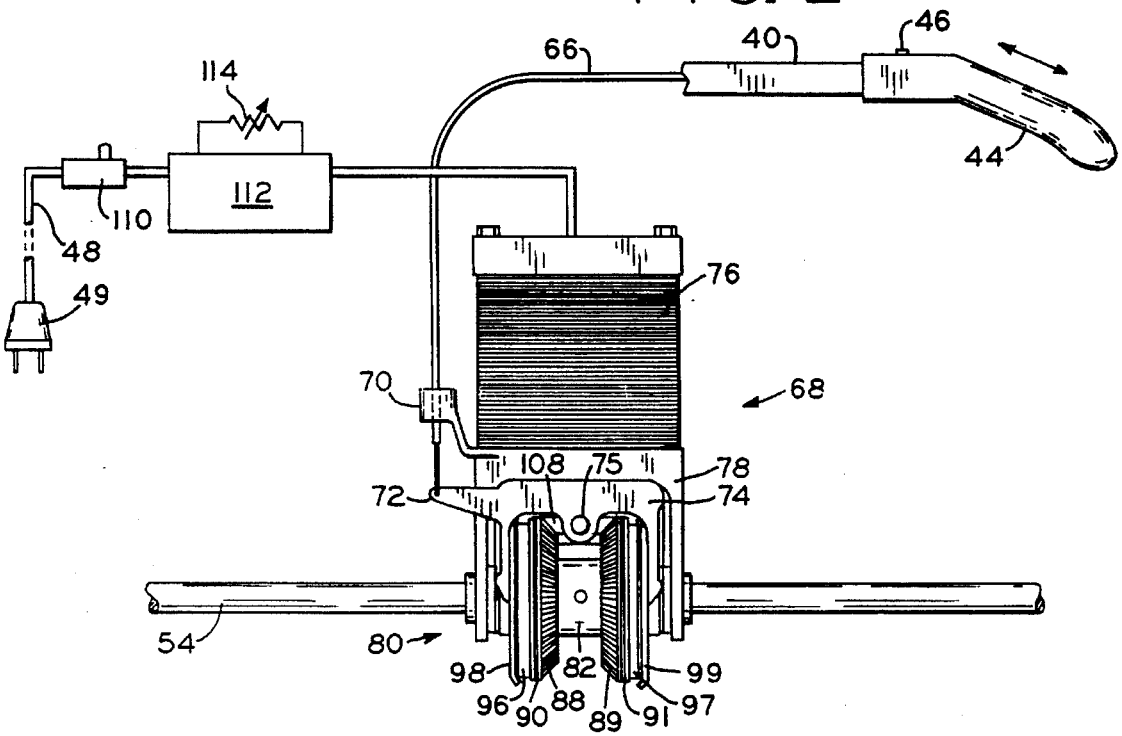
FIG. 3 is a front elevational view of the transmission unit of the present invention depicted in a neutral position.
Figure 6:
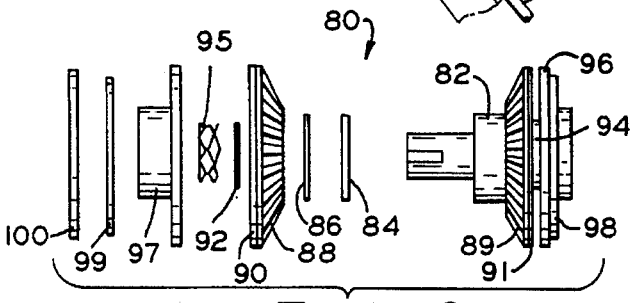
FIG. 6 is an exploded view of the clutch pack assembly.

The transmission assembly 68, with reference to FIGS. 3, and 6, includes a cable support 70, a clutch actuator lever 72, and a clutch actuator 74 pivotable around actuator pivot 75, while a sheathed cable 66 controls the clutch actuator 74 being attached to the clutch actuator lever 72. Movement of cable 66 causes the clutch actuator 74 to pivot around actuator pivot 75 from its center neutral position depending on the direction of cable movement, that is either pulling or pushing. In addition, the transmission assembly 68 includes a transmission motor 76 mounted on motor support/inner axle bearing 78, and a clutch pack 80. Clutch pack 80, as shown in FIG. 6, is a dual opposed system designed such that unidirectional rotational motion from transmission motor 76 may be translated to bidirectional rotation of axle 54, thus providing forward and reverse movement. Clutch pack 80 includes a collar 82 on which is identically mounted on both sides, in placement order, an inner thrust bearing 84 (no counterpart shown), an inner bearing race 86 (no counterpart shown), bevel ring gears 88 and 89, gear pads 90 and 91, washer 92 (no counterpart shown), spiral wave springs 94 and 95, force plates 97 and 98, outer thrust bearings 98 and 99, and outer bearing race 100 (no counterpart shown). The clutch pack 80 is mounted on or made integral with axle 54 as depicted in FIGS. 2 and 3.

Figure 4:
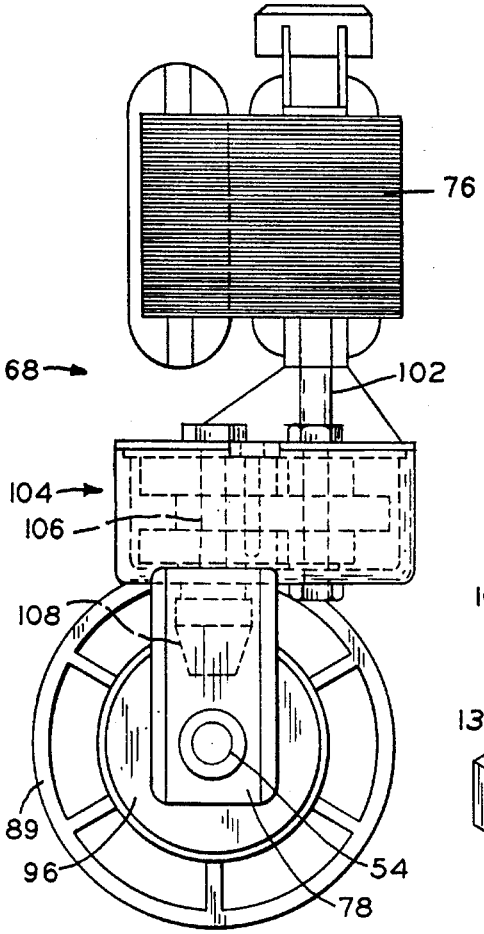
FIG. 4 is a side elevational view of the transmission unit of the present invention.
Figure 10:
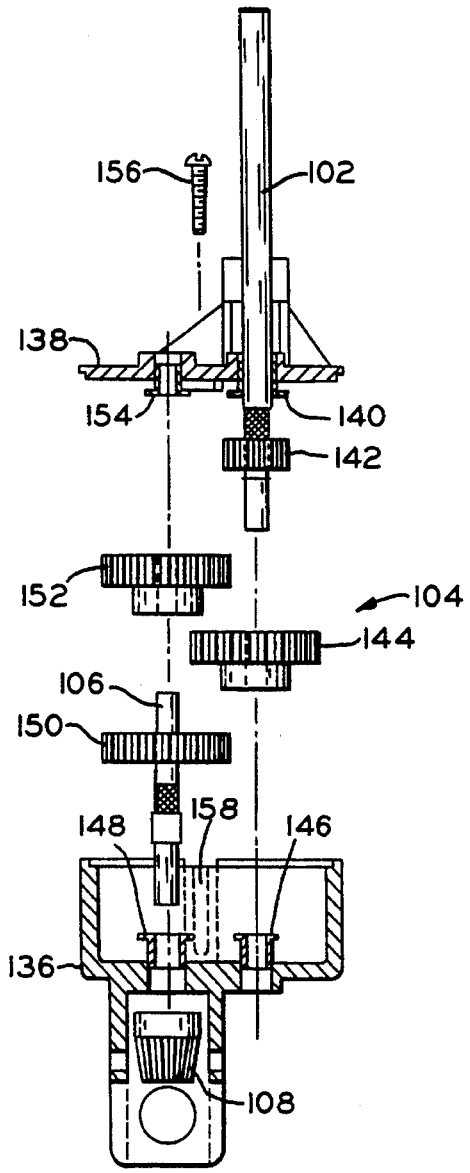
FIG. 10 is an exploded view of the transmission gear assembly.

The transmission motor 76 is a typical unidirectional AC induction motor mounted on the motor support 78 disposed above the clutch pack 80. Referring to FIG. 4, the transmission assembly 68 further includes a motor shaft 102 extending into a motor gear assembly 104 as motor shaft 102 imparts its rotational velocity to output shaft 106 which has a bevel pinion gear 108 attached on its output end. As shown in FIG. 10, gear assembly 104 is disposed in gearbox housing 136 which contains the gearing linking motor shaft 102 with output shaft 106. Motor shaft 102 extends through gearbox housing cover 138 rotatably supported by motor shaft cover bearing 140 and has a motor shaft output gear 142 and a motor shaft intermediate gear 144 disposed thereon, the motor shaft 102 rotatably supported in motor shaft housing bearing 146. The output shaft 106 is rotatably supported in output shaft housing bearing 148 and has secondary output shaft Gear 150 and an output shaft intermediate Gear 152 disposed thereon in meshing engagement with the motor shaft output gear 142 and the motor shaft intermediate gear 144 so as to be rotated thereby, the output shaft 106 being rotatably supported in gearbox housing cover 138 by output shaft cover bearing 154. The gearbox housing cover 138 is attached to the gearbox housing 136 by two screws 156 of which only one is shown that are received in gearbox housing screw bores 158 of which only one is shown. The gear assembly 104 thus connects motor shaft 102 to output shaft 106, while gear assembly 104 may include reduction gearing providing a 10:1 three step gear reduction, or other suitable ratio and steps as well as having no reduction gearing at all.

Bevel pinion gear 108 engages and rotates both of bevel ring gears 88 and 89 in opposite directions depending on the desired direction of movement (forward or reverse) which is determined by the direction of pivot of the clutch actuator 74 which pushes one force plate 96 or 97 of the clutch pack 80 into engagement with the respective bevel gear 88 or 89 thus causing rotation to be imparted to axle 54 determined by the operator by movement of cable 66 through handle 44. The actuation of clutch actuator 74 is accomplished through action by the operator from forward and reverse movement of the handle 44 being in communication with the clutch actuator through cable 66. As shown in FIG. 3, the transmission motor 76 is connected via power cord 48 and plug 49 to an electrical source (not shown). An on/off switch 110 is provided as well as an electronic speed control unit 112 having, a manually or an automatically controlled speed adjust mechanism 114 between the electrical source and transmission motor 76. The speed control unit 112 is thus in series with the transmission motor power supply (not shown) and includes a triac (not shown) for varying the phase of the power supply current to control the motor speed. By varying the phase of the power supply current to the transmission motor 76, the output to the drive axle 54 and thus the speed of the vacuum cleaner is controlled. The speed control unit 112 can thus be either a manual control regulated by the operator or an automatic control regulated by the vacuum cleaner in response to torque transmitted back to the motor or any other scheme which accomplishes the same result.

Figure 5:
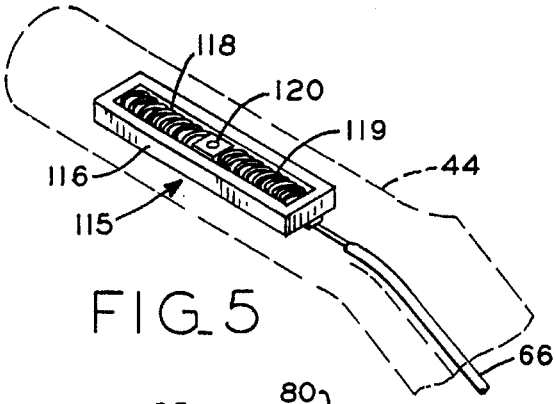
FIG. 5 is an elevational perspective view of a handle assembly embodying the neutral return mechanism.

Particularly in reference to FIG. 5, the sheathed cable 66 controlling clutch actuator 74 through clutch actuator lever 72 may be connected to a transmission touch control unit 115 located in handle grip 44. The transmission touch control unit 115 comprises a spring retainer 116, housing two springs 118 and 119 being separated by a piston mechanism 120 to which the sheathed cable 66 is connected. Transmission touch control unit 115 works in conjunction with the spiral wave springs 94 and 95 located integral with the clutch pack 80 (see FIG. 6) to provide a smoothness to the actuating of the transmission. As the handle grip 44is pushed in a forward direction or pulled in a reverse direction, depending on the desired direction of vacuum cleaner travel, springs 118 and 119 along with the spiral wave springs 94 and 95 keep the gears 88 and 89 properly engaged with the pinion gear 108 and are also used in biasing the transmission to a neutral position when not in use. As the operator lets go of the handle or is no longer pushing or pulling the handle grip 44, springs 118 and 119 along with piston mechanism 120 and spiral wave springs 94 and 95 (FIG. 6) force the transmission assembly 68 into a neutral position by biasing the clutch actuator 74 such that neither force plate 96 or 97 is in engagement with bevel gears 88 or 89.

Figure 7:
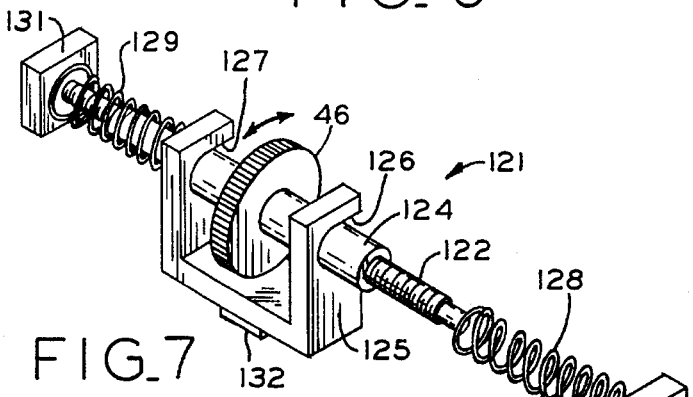
FIG. 7 is an elevational perspective view of the adjustable transmission response device.
Figure 11:
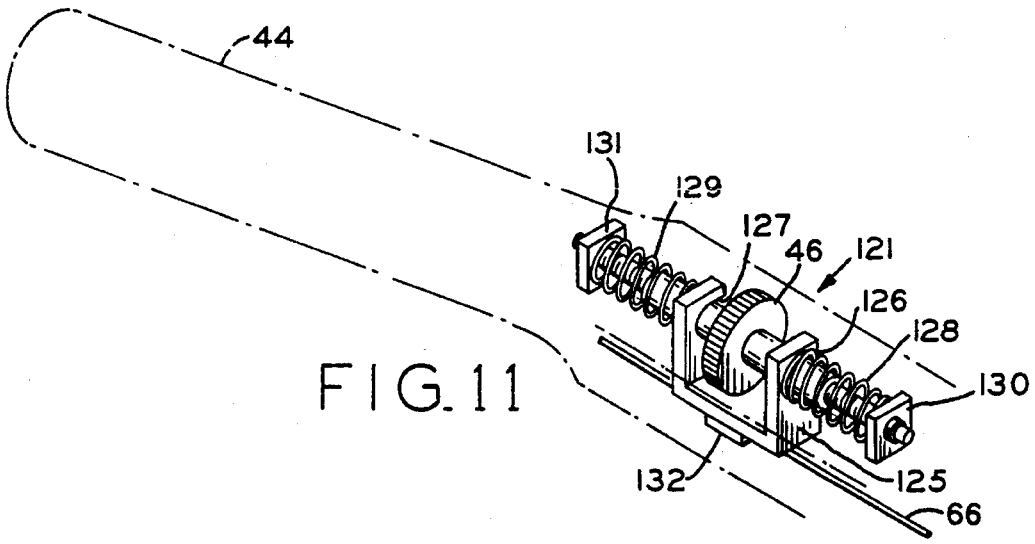
FIG. 11 is perspective view of the adjustable transmission response device shown in the handle.

Referring now to FIGS. 7, 8, 9, and 11, the power assisted upright vacuum cleaner of the present invention includes in addition to the transmission touch control unit 115 or as an alternative to the transmission touch control unit 115 an adjustable actuator response assembly 121. The adjustable actuator response assembly 121 gives the operator of the power assisted upright vacuum cleaner of the present invention the ability to select the actuation level of the vacuum cleaner 20 and transmission in response to a given amount of force or movement applied to the handle grip 44. The adjustable response assembly 121 thus allows the operator to selectively adjust the tension of the handle grip 44 such that the vacuum cleaner 20 and transmission assembly 68 either slowly or quickly responds to a given amount of force or movement, when moving the handle grip 44 in a forward or reverse direction. The distance the handle grip 44 travels before the transmission assembly 68 is engaged and the vacuum cleaner 20 overcomes the frictional force of the floor covering to the wheels 30 and 31, determines the type of response. Depending on the setting of the adjustable response assembly 121, the travel distance of the handle grip 44 may be either short or long corresponding to a quick or slow response of the vacuum cleaner 20. Disposed on the handle tube 40 adjacent handle grip 44 at the point of connection with handle tube 40 is the adjustable response assembly 121. The disposition of the adjustable response assembly 121 below handle 44 is shown in FIG. 11. Cable 66 is attached to a cable attachment hole 134 in a cable attachment flange 132 radially disposed on the underside of cable attachment slide 125. Thus, as the double ended screw 122 is moved through movement of the handle 44, the displacement is transferred to the cable attachment slide 125 through the compression of springs 128 or 129. The movement of the attachment slide 125 is transferred through cable 66 being attach thereto, to the pivot clutch actuator 74. Adjustable response assembly 121 as shown in FIG. 7 has a double ended screw 122 which has a shoulder area 124 separating the screws, the shoulder area 124 has a thumbwheel 46 located in the center. The cable attachment slide 125 fits on the double ended screw 122 through two U-shaped notches 126 and 127 which locate themselves on the shoulder area 124 with the thumbwheel 46 between them. The movement of thumbwheel 46 in either direction, indicated by a double tipped arrow, causes the double ended screw 122 to rotate, the direction of rotation being the same as thumbwheel 46. Disposed on either end of doubled ended screw 122 abutting a respective side of cable attachment slide 125 are springs 128 and 129 being held in place by a left hand nut 130 and a right hand nut 131. Nuts 130 and 131 are respectively left and right handed to cause concurrent compression or retraction of springs 128 and 129 when thumbwheel 46 is rotated, as explained in further detail hereinbelow with reference to FIGS. 8 and 9 in conjunction with the operation of the adjustable response assembly 121. As thumbwheel 46 is turned in either direction, each nut 130 and 131 moves in an opposite direction to correspondingly compress or expand springs 128 and 129. That is, each nut 130 and 131 moves inwardly to compress springs 128 and 129 and each nut moves outwardly to expand springs 128 and 129 depending on the direction of thumbwheel 46 movement depending on a slow or fast transmission response.

Figure 8:
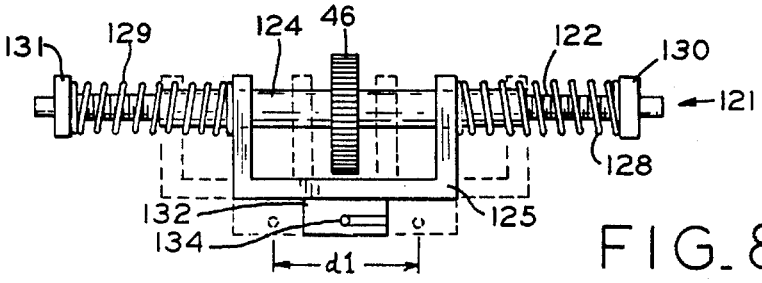
FIG. 8 is a front elevational view of the adjustable transmission response device depicted in its maximum movement and slow response mode.
Figure 9:
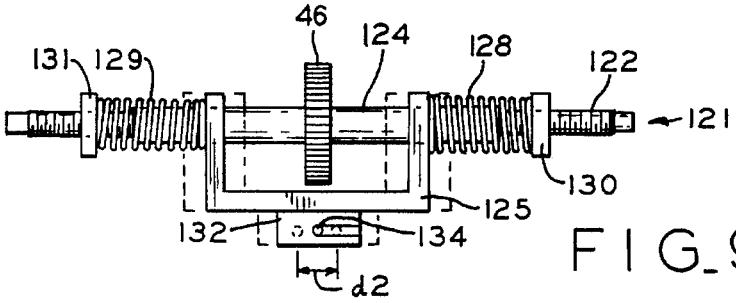
FIG. 9 is a front elevational view of the adjustable transmission response device depicted in its minimum movement and fast response mode.

As the operator moves the handle grip 44, either in the forward or reverse direction, the motion is transferred to the transmission via the sheathed cable 66 attached to the clutch actuator lever 72 which causes the clutch actuator 74 to pivot around actuator pivot 75, the rotational direction of clutch actuator 74 around actuator pivot 75 is dependent upon the direction of handle movement which depends on whether the vacuum cleaner is to be moved in the forward or reverse direction as hereinabove explained. FIG. 8 shows the adjustable response assembly 121 in its slow response mode thus having the maximum cable movement displacement d1. Springs 128 and 129 are at a minimum compression level which allows the largest displacement of cable attachment slide 125, when handle grip 44 is moved either in the forward or reverse direction. FIG. 4 shows the adjustable response assembly 121 in its fast response mode thus having the minimum cable movement displacement d2. Springs 128 and 129 are at a maximum compression level which permits the smallest displacement of cable attachment slide 125, when handle grip 44 is moved either in the forward or reverse direction. It is to be noted that FIGS. 8 and 9 illustrate only the extreme limits of the adjustable response assembly 121 in that a range of various displacements having various spring compression levels are possible and contemplated.

Explained in further detail, once the resistance of the springs 128 and 129 are overcome due to their compression or expansion, the force exerted on the handle grip 44 translates into vacuum cleaner 20 motion in conjunction with the power assist device. A high spring compression as in FIG. 9 produces a fast response since less movement is required to overcome the spring tension permitting the force exerted to more quickly translate into vacuum cleaner motion. A low spring compression as in FIG. 8 produces a slow response since more movement is required to overcome the low spring tension causing the force exerted to be slowly translated into vacuum cleaner motion.

In operation, the upright vacuum cleaner of the present invention receives electrical power through plug 49 and power cord 48 which is selectively switched to the various electrical components such as transmission motor 76 through on/off switch 110. When the operator moves the vacuum cleaner either in the forward or reverse direction, the handle grip 44 moves in response to the pushing or pulling according to the setting of the adjustable response assembly 121 which in turn actuates the transmission assembly 68 and clutch pack 80 to selectively rotate the axle 54 and drive wheels 30 and 31 to help assist the operator by propelling the vacuum cleaner in the desired direction.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A drive system in a power assisted upright vacuum cleaner having a suction motor, said drive system comprising:

a drive axle having a wheel at each end thereof.;

a unidirectional drive motor separate from the suction motor;

a clutch pack mount. On said drive axle selectively operable to rotate said drive axle in either a forward or a reverse direction;

clutch actuator means for selectively engaging said clutch pack with said drive motor;

a slidable handle;

a cable attached at one end to said handle and attached at the other end to said Clutch actuator means.;

biasing means disposed within said handle for biasing said handle into a neutral position upon release of said handle; and spring means operably connected to said clutch pack for urging said clutch pack away from said clutch actuator means in the absence of biasing from said clutch actuator means.

2. The drive system of claim 1, wherein said biasing means comprises:

a retainer attached to said cable;

a piston disposed within said retainer; and two springs disposed on opposite sides of said retainer, said springs disposed on opposite sides of said piston and adapted to resiliently urge said retainer and said piston such that movement of said handle compresses one spring and expands the other spring, whereupon release of movement of said handle causes said springs to bias said handle such that said cable biases said clutch actuator means into said neutral position.

3. The drive system of claim 1, further comprising speed control means connected to said drive motor for controlling the rotational speed of said motor.

4. The drive system of claim 1, further comprising reduction gearing disposed between said drive motor and said clutch pack.

5. The drive system of claim 1, further comprising adjustable response means operably connected to said slideable handle for controlling the actuation of said vacuum cleaner in response to a given amount of force exerted on said slideable handle.

6. The drive system of claim 5 wherein said adjustable response means comprises:

a cable attachment slide operably connecting the one end of said cable to said slideable handle;

tension means for restricting movement of said cable attachment slide; and means for adjusting said tension means,

7. A drive system in a power assisted upright vacuum cleaner having a suction fan and a rotatable agitator brush, said drive system comprising:

a drive axle having a wheel at each end thereof;

a power transmission assembly having an input shaft and an output shaft;

a unidirectional drive motor mounted in operations relation power transmission assembly, said drive motor being dedicated to operably provide mechanical power to said drive system but not to said suction fan nor said agitator brush, said drive motor including a motor output shaft in mechanical communication with said power transmission input shaft;

a clutch pack mounted on said drive axle, said clutch pack selectively operable to rotate said drive axle in either a clockwise or counterclockwise direction;

clutch actuator means for selectively engaging said clutch pack with said power transmission output shaft; and control means connected to said clutch actuator means for selectively controlling said clutch actuator.

8. The drive system of claim 7, wherein said control means comprises:

a slidable handle;

a control cable connected at one end to said slidable handle and connected at the other end to said clutch actuator means; and neutral positioning means for returning said clutch actuator means to a neutral position in the absence of an external biasing force.

9. The drive system of claim 8, wherein said neutral positioning means comprises:

biasing means disposed within said handle for biasing said handle into said neutral position upon release of said handle; and spring means operably connected to said clutch pack for urging said clutch pack away from said clutch actuator means in the absence of biasing from said clutch actuator means.

10. The drive system of claim 9, where said biasing means comprises:

a retainer attached to said cable;

a piston disposed within said retainer; and two springs disposed on opposite sides of said retainer, said springs located on opposite side of said piston and biasing against said retainer and said piston such that movement of said handle compresses one spring and expands the other spring, whereupon release of movement of said handle causes said springs to bias said handle such that said cable biases said clutch actuator means into said neutral position.

11. The drive system of claim 7, further comprising adjustable response means connected to said control means for controlling the actuation of said vacuum cleaner in response to a given amount of force exerted on said control means.

12. The drive system of claim 11, wherein said adjustable response means comprises:

a cable attachment slide operably connected by a cable to said clutch actuator means;

tension means for restricting movement of said cable attachment slide; and means for adjusting said tension means.

13. The drive system of claim 7, wherein said drive system further includes speed set means in communication with said drive motor for adjusting the speed of said drive motor.

14. A power assisted upright vacuum cleaner comprising:

a base unit;

a drive housing attached to said base unit;

a shaft attached to said drive housing;

a slidable handle attached to said shaft;

a suction assembly disposed within said drive housing, said suction assembly including a suction conduit, and a suction fan in communication with said suction conduit;

a rotatable agitator brush disposed within said base unit;

a drive axle having a wheel at each end thereof, said drive axle disposed in said base unit;

a unidirectional drive motor dedicated to operably provide rotational energy to said drive axle but not to said suction fan nor said agitator brush;

a transmission for transferring the rotational energy from said drive motor to said drive axle, whereby said drive axle is selectively rotatable in a clockwise or counter-clockwise direction;

transmission actuator means for selectively engaging said transmission with said drive motor; and means for controlling said transmission actuator means.

15. The vacuum cleaner of claim 14, wherein said transmission comprises a clutch pack mounted on said drive axle.

16. The vacuum cleaner of claim 14, further comprising a transmission response assembly disposed in said handle.

17. The vacuum cleaner of claim 14, further comprising a speed adjust mechanism communicating with said drive motor for adjusting the speed of said drive motor.

18. The vacuum cleaner of claim 14, further comprising a gearbox disposed between said drive motor and said transmission.

19. The vacuum clearer of claim 18, wherein said gearbox includes reduction gearing.

20. The vacuum cleaner of claim 14, further comprising adjustable response means connected to said control means for controlling the actuation of said vacuum cleaner in response to a given amount of force exerted on said control means.

21. The vacuum cleaner of claim 14, wherein said control means comprises:

a cable attached at one end to said slidable handle and attached at the other end to said transmission actuator means; and neutral positioning means for returning said transmission actuator means to a neutral position in the absence of an external biasing force.

22. The vacuum cleaner of claim 21 wherein said slidable handle includes a rod having oppositely threaded ends and a slide centrally axially mounted on said rod, said slide being axially displaceable on said rod.

23. The vacuum cleaner of claim 14 wherein said slidable handle includes a slide axially displaceable along a rod-like mounting means for attaching said slide to said slidable handle, whereby said slide is axially displaceable relative to said slidable handle.

24. In a power assisted upright vacuum cleaner having a transmission controlled by an operator through a cable, an adjustable response apparatus for setting the force necessary to engage the transmission and propel the vacuum cleaner, said adjustable response apparatus comprising:

a slide;

rod-like mounting means to which said slide is attached such that said slide is axially displaceable on said mounting means;

means for attaching the cable to said slide;

tension means on said mounting means for restricting the axial displacement of said slide; and tension adjustment means for selectively controlling the tension of said tension means.

25. The apparatus of claim 24, wherein said tension means comprises:

a pair of spring retainers movably mounted on the ends of said mounting means; and a pair of springs disposed on the ends of said mounting means between said slide and a respective spring retainer.

26. The apparatus of claim 24, wherein said tension adjustment means comprises a thumbwheel mounted on said mounting means adjacent said slide.

27. In a power assisted upright vacuum cleaner having a transmission controlled by an operator through a cable, an adjustable response apparatus for setting the force necessary to engage the transmission and propel the vacuum cleaner, said adjustable response apparatus comprising:

a rod having oppositely threaded ends;

a slide centrally axially mounted on said rod, said slide being axially displaceabie on said rod;

cable attachment means disposed on said slide;

tension means mounted on said rod for restricting the axial displacement of said slide; and tension adjustment means for selectively controlling the tension of said tension means.

28. The apparatus of claim 27, wherein said tension means comprises:

a spring retainer movably mounted on each end of said rod; and a spring disposed on each end of said rod between said slide and a respective spring retainer.

29. The apparatus of claim 27, wherein said tension adjustment means comprises a thumbwheel mounted on said rod adjacent said slide.

30. In combination, a power assisted upright vacuum cleaner having a cable and a transmission controlled by an operator through said cable, and an adjustable response apparatus for setting the force necessary to engage the transmission and propel said vacuum cleaner, said adjustable response apparatus comprising:

a rod-like mounting means;

a slide attached to said rod-like mounting means, whereby said slide is axially displaceable along said mounting means;

means for attaching said cable to said slide;

tension means on said mounting means for restricting the axial displacement of said slide; and tension adjustment means for selectively controlling the tension of said tension means.

31. In combination, a power assisted upright vacuum cleaner having a cable and a transmission controlled by an operator through said cable, and an adjustable response apparatus for setting the force necessary to engage the transmission and propel the vacuum cleaner, said adjustable response apparatus comprising:

a rod having oppositely threaded ends;

a slide centrally axially mounted on said rod, said slide being axially displaceable on said rod;

cable attachment means disposed on said slide for securing said cable thereto;

tension means mounted on said rod for restricting the axial displacement of said slide; and tension adjustment means for selectively controlling the tension of said tension means.

* * * * *